US011123263B2

(12) United States Patent
Lee

(10) Patent No.: US 11,123,263 B2
(45) Date of Patent: Sep. 21, 2021

(54) PILL BOX

(71) Applicant: E-LINK PLASTIC & METAL INDUSTRIAL CO., LTD., New Taipei (TW)

(72) Inventor: Cheng-Hua Lee, New Taipei (TW)

(73) Assignee: E-LINK PLASTIC & METAL INDUSTRIAL CO., LTD., New Taipei (TW)

( * ) Notice: Subject to any disclaimer, the term of this patent is extended or adjusted under 35 U.S.C. 154(b) by 214 days.

(21) Appl. No.: 16/672,595

(22) Filed: Nov. 4, 2019

(65) Prior Publication Data

US 2021/0128405 A1 May 6, 2021

(51) Int. Cl.
*A61J 1/03* (2006.01)
*A61J 7/00* (2006.01)

(52) U.S. Cl.
CPC ..... *A61J 1/03* (2013.01); *A61J 7/0084* (2013.01)

(58) Field of Classification Search
CPC .... A61J 1/03; A61J 7/04; A61J 7/0069; A61J 7/0084; A61J 7/0436; B65D 83/04; B65D 83/0445
USPC ..... 206/538, 532, 534–535; 220/266, 220/523–524, 532; 221/154
See application file for complete search history.

(56) References Cited

U.S. PATENT DOCUMENTS 3,079,028 A * 2/1963 Rosner ..... B65D 25/04 220/532
4,038,937 A * 8/1977 Moe ..... A61J 7/0084 116/308
4,372,445 A * 2/1983 Keffeler ..... B65D 21/0204 206/532
4,735,318 A * 4/1988 Keffeler ..... A61J 1/03 206/532
4,741,441 A * 5/1988 Keffeler ..... A61J 1/03 206/532
4,749,085 A * 6/1988 Denney ..... B65D 25/103 206/459.5
4,793,492 A * 12/1988 Halbich ..... A45C 11/24 206/538
5,011,018 A * 4/1991 Keffeler ..... B65D 83/0445 206/532
5,267,650 A * 12/1993 Gilbilisco ..... A61J 1/03 206/534
5,489,025 A * 2/1996 Romick ..... A61J 7/0076 206/531

(Continued)

*Primary Examiner* — Shawn M Braden
*Assistant Examiner* — Brijesh V. Patel
(74) *Attorney, Agent, or Firm* — WPAT, PC

(57) ABSTRACT

A pill box has a container having a compartment frame, multiple front covers pivotally mounted to the container and selectively covering a front side of the container, and a rear lid. The rear lid is detachably mounted on a rear side of the container and has a main covering panel having an outer peripheral frame and multiple inner annular frames, and two side locking panels. With the compartment frame of the container protruding in a groove formed between the outer peripheral frame and the inner peripheral frames of the main covering panel when the main covering panel covers the rear side of the container, the rear side of the container can be tightly sealed by the rear lid easily, so as to prevent dust and moisture from entering the pill box. Accordingly, pills can be properly reserved in the pill box of the present application.

16 Claims, 9 Drawing Sheets

(56) References Cited

U.S. PATENT DOCUMENTS

| | | | | | |
|---|---|---|---|---|---|
| 5,735,406 | A * | 4/1998 | Keffeler | A61J 1/03 | 206/535 |
| D418,288 | S * | 1/2000 | Priebe | B65D 21/0204 | D3/201 |
| 7,267,228 | B2 * | 9/2007 | Keffeler | B65D 21/0202 | 206/528 |
| 7,395,929 | B2 * | 7/2008 | Keffeler | B65D 83/0445 | 206/528 |
| 7,793,785 | B2 * | 9/2010 | Keffeler | B65D 83/04 | 206/538 |
| 8,596,487 | B1 * | 12/2013 | Su | B25H 3/06 | 220/524 |
| 8,794,482 | B2 * | 8/2014 | Sack | B65D 83/0454 | 221/80 |
| 9,427,377 | B1 * | 8/2016 | Miceli | A61J 7/04 | |
| 9,770,390 | B2 * | 9/2017 | Aggarwal | A61J 7/04 | |
| 2006/0006091 | A1 * | 1/2006 | Maietta | B65D 83/0463 | 206/539 |
| 2014/0251862 | A1 * | 9/2014 | Priebe | A61J 1/03 | 206/534 |

* cited by examiner

PILL BOX

BACKGROUND OF THE INVENTION

1. Field of the Invention

The present invention relates to a pill box, especially to a pill box that has improved sealing effect.

2. Description of the Prior Art(s)

A pill box has multiple compartments for storing scheduled doses of medications, so as to prevent or reduce medication errors on the part of the patient.

With reference to FIG. 8, a conventional pill box 60 comprises a container 61, multiple front covers 62, and a rear cover 63. An interior of the container 61 is divided into multiple compartments 610. Each of the compartments 610 is defined through a front side of the container 6 and a rear side of the container 61. The front covers 62 are pivotally mounted to the container 61 and are capable of covering the front side of the container 61 to seal the compartments 610 respectively. The rear cover 63 is pivotally mounted to the container 61 and is capable of covering the rear side of the container 61 to seal the compartments 610.

The rear cover 63 can be opened to reveal all of the compartments 610 at the same time for the convenience of dispensing pills, such as tablets and capsules, to the compartments 610 to prepare a one week or a one month supply. Each of the front covers 62 can be opened individually for deriving the pills that are for one time section.

However, as shown in FIG. 8, in the conventional pill box 60, the container 61 has a peripheral sidewall 611, multiple crosswise partitions 612, at least one lengthwise partition 613 and multiple engaging recesses 614. The crosswise partitions 612 and the at least one lengthwise partition 613 is surrounded by and is connected to the peripheral sidewall 611 and divide the interior of the container 61 into said multiple compartments 610. The engaging recesses 614 are formed in rear edges of the crosswise partitions 612 respectively. The rear cover 63 has an inner surface facing toward the container 61, multiple pairs of holding ribs 631, and multiple engaging protrusions 632. The pairs of the holding ribs 631 are separately formed on the inner surface of the rear cover 63. The engaging protrusions 632 separately protrude from the inner surface of the rear cover 63.

When the rear cover 63 covers on the container 61, the rear cover 63 is laid on the rear side of the container 61, each pair of the holding robs 631 hold a corresponding one of the crosswise partition 612, and the engaging protrusions 632 engage in the engaging recesses 614 respectively.

With reference to FIGS. 8 and 9, for fear that dust and moisture might enter the conventional pill box 60 and the pills might drop out of the conventional pill box 60 through a gap between the peripheral sidewall 611 of the container 61 and the rear cover 63, the user has to press the rear covers 63 to allow all of the engaging protrusions 632 to engage in the engaging recesses 614 of the container 61 when closing the rear cover 63.

In order to avoid loosening, the engaging protrusions 632 and the engaging recesses 614 have to be closely fitted with each other, causing difficulties in opening and closing the rear cover 63. However, if the engaging protrusions 632 and the engaging recesses 614 are loosely fitted with each other for the convenience of easy opening and closing, the engaging protrusions 632 would disengage from the engaging recesses 612 easily, such that the rear cover 63 is detached from the container 61 easily. Consequently, connecting structure between the container 61 and the rear cover 63 of the conventional pill box 60 is not suitable for reserving the pills.

To overcome the shortcomings, the present invention provides a pill box to mitigate or obviate the aforementioned problems.

SUMMARY OF THE INVENTION

The main objective of the present invention is to provide a pill box that comprises a container, multiple front covers, and a rear lid.

The container has a peripheral sidewall, multiple crosswise partitions, two first locking portions, and a compartment frame. The crosswise partitions are surrounded by and are connected to the peripheral sidewall and divide an interior of the container into multiple compartments. The first locking portions are oppositely formed on an outer surface of the peripheral sidewall. The compartment frame is formed on a rear side of the container and is disposed along the peripheral sidewall and the crosswise partition.

The front covers are pivotally mounted to the container and selectively cover a front side of the container to seal the compartments respectively.

The rear lid is detachably mounted on the rear side of the container and has a main covering panel and two side locking panels. The main covering panel covers the rear side of the container and has an outer peripheral frame and multiple inner annular frames. The outer peripheral frame is formed on an inner surface of the main covering panel. The inner annular frames are formed on the inner surface of the main covering panel, are surrounded by the outer peripheral frame and correspond in position to the compartments of the container respectively. Each of the inner annular frames corresponds in shape to a corresponding one of the compartments. The side locking panels are pivotally connected to two opposite side edges of the main covering panel. Each of the side locking panels has a second locking portion detachably engaging with the first locking portions of the container respectively.

With the compartment frame of the container protruding in a groove formed between the outer peripheral frame and the inner peripheral frames of the main covering panel of the rear lid when the main covering panel covers the rear side of the container and by hooking the two side locking panels to the peripheral sidewall of the container, the rear side of the container can be tightly sealed by the rear lid easily. Dust and moisture does not enter the pill box through the rear side of the container while the rear lid covers the rear side of the container. Accordingly, the pills can be properly reserved in the pill box of the present application.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
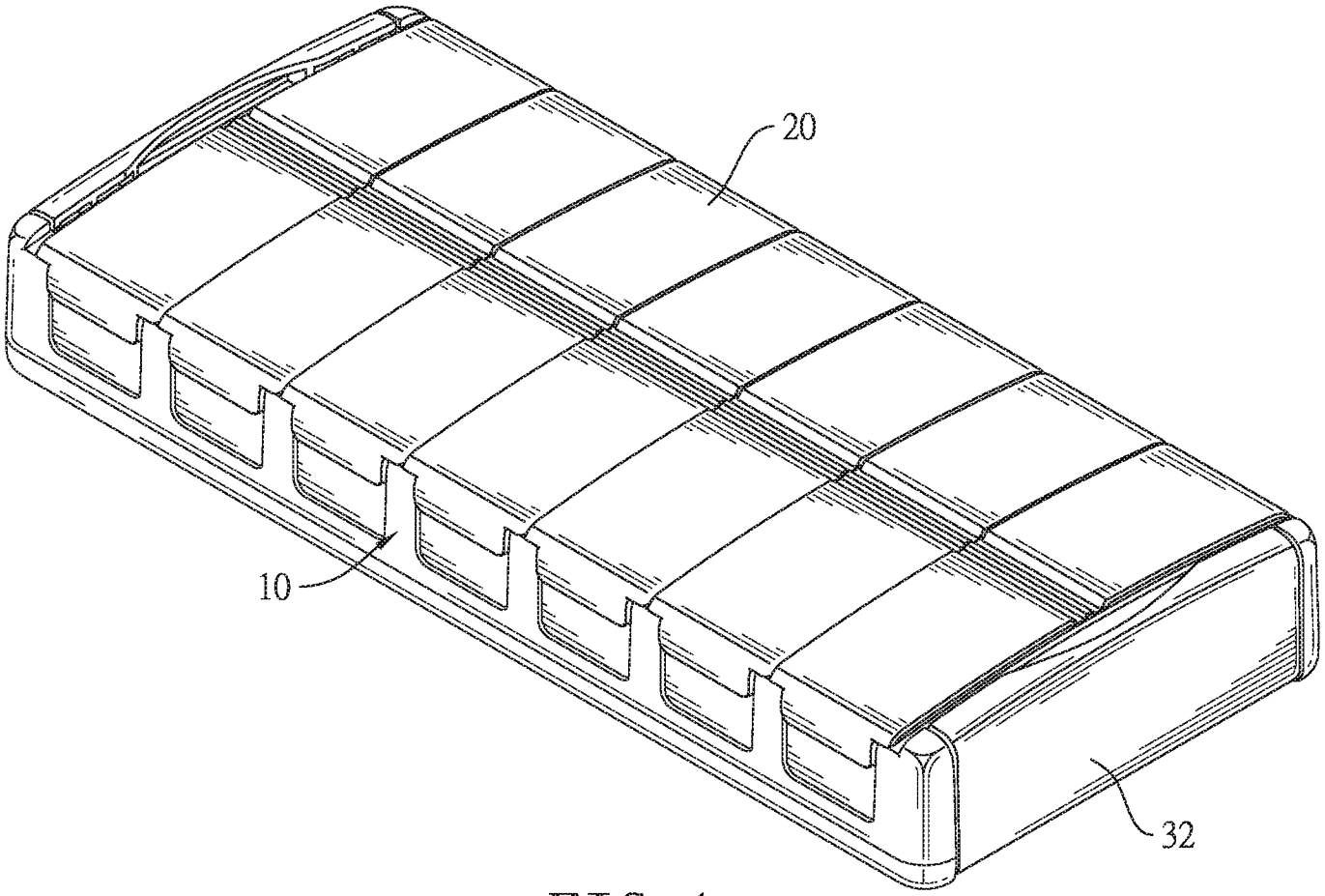
FIG. 1 is a top perspective view of a pill box in accordance with the present invention.
Figure 2:
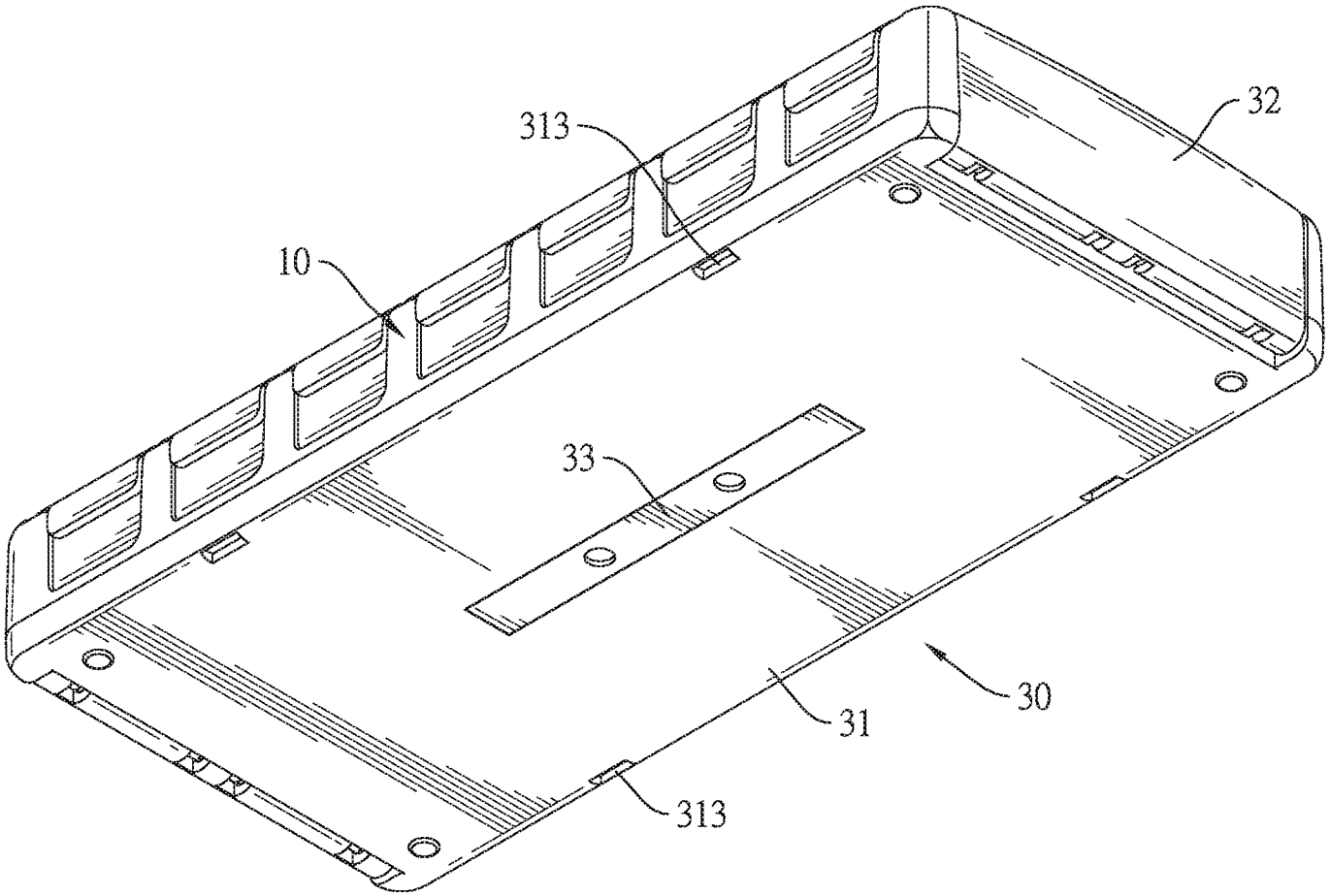
FIG. 2 is a bottom perspective view of the pill box in FIG. 1.

With reference to FIGS. 1 and 2, a pill box in accordance with the present invention comprises a container 10, multiple front covers 21, and a rear lid 30.

Figure 3:
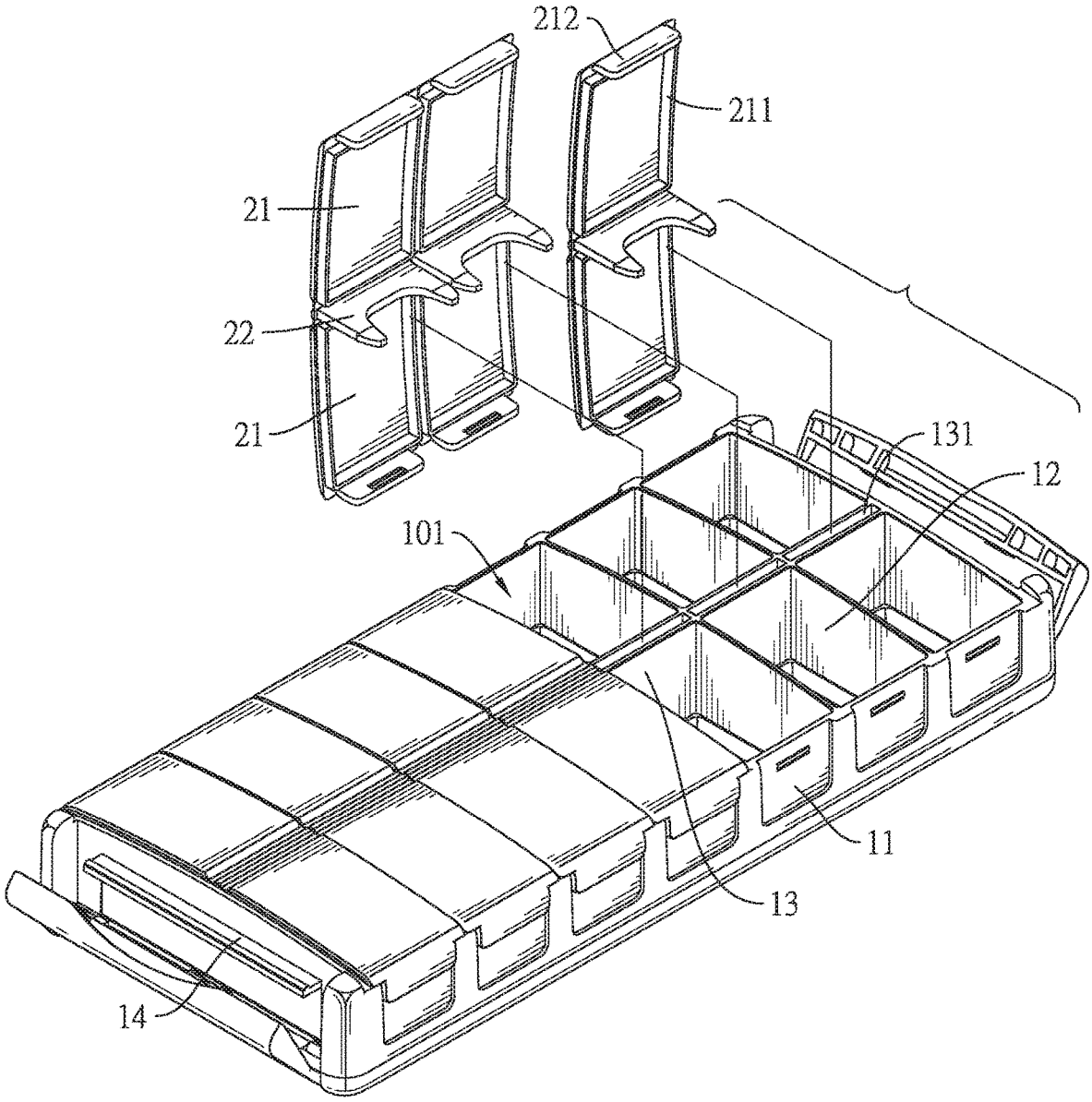
FIG. 3 is a top exploded perspective view of the pill box in FIG. 1.
Figure 4:
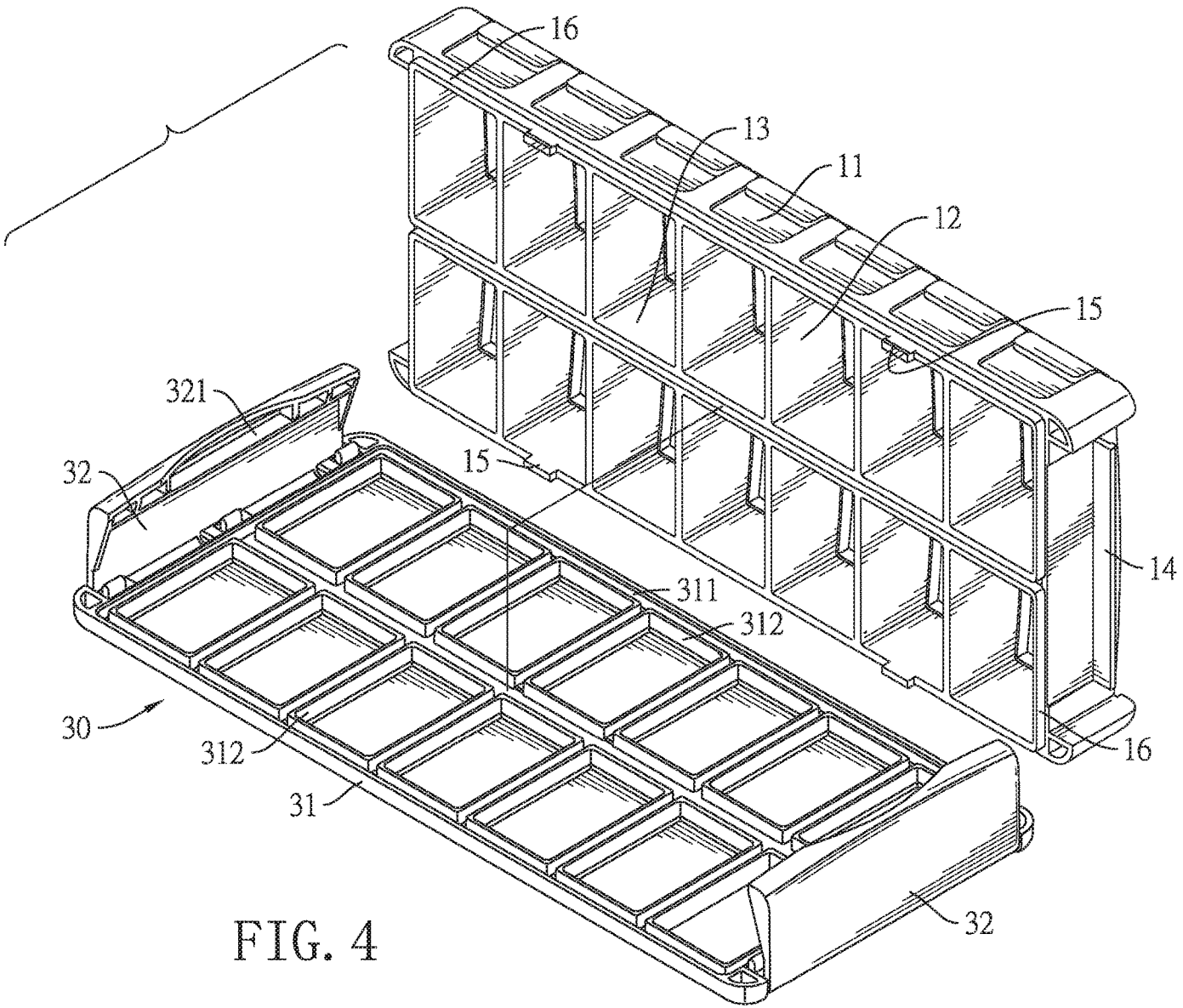
FIG. 4 is a bottom exploded perspective view of the pill box in FIG. 1.

With further reference to FIGS. 3 and 4, the container 10 has a front side, a rear side, a peripheral sidewall 11, multiple crosswise partitions 12, at least one lengthwise partition 13, two first locking portions 14, at least one aligning protrusion 15, and a compartment frame 16.

The crosswise partitions 12 and the at least one lengthwise partition 13 are surrounded by and are connected to the peripheral sidewall 11 and divide an interior of the container 10 into multiple compartments 101. Each of the compartments 101 is defined through the front side and the rear side of the container 10. The compartments 101 are for storing pills, such as tablets and capsules.

The first locking portions 14 are oppositely formed on an outer surface of the peripheral sidewall 11. The at least one aligning protrusion 15 protrudes from the rear side of the container 10. Specifically, the at least one aligning protrusion 15 is formed on the peripheral sidewall 11 of the container 10. The compartment frame 16 is formed on the rear side of the container 10 and is disposed along the peripheral sidewall 11, the crosswise partition 12 and the at least one lengthwise partition 13.

Figure 5:
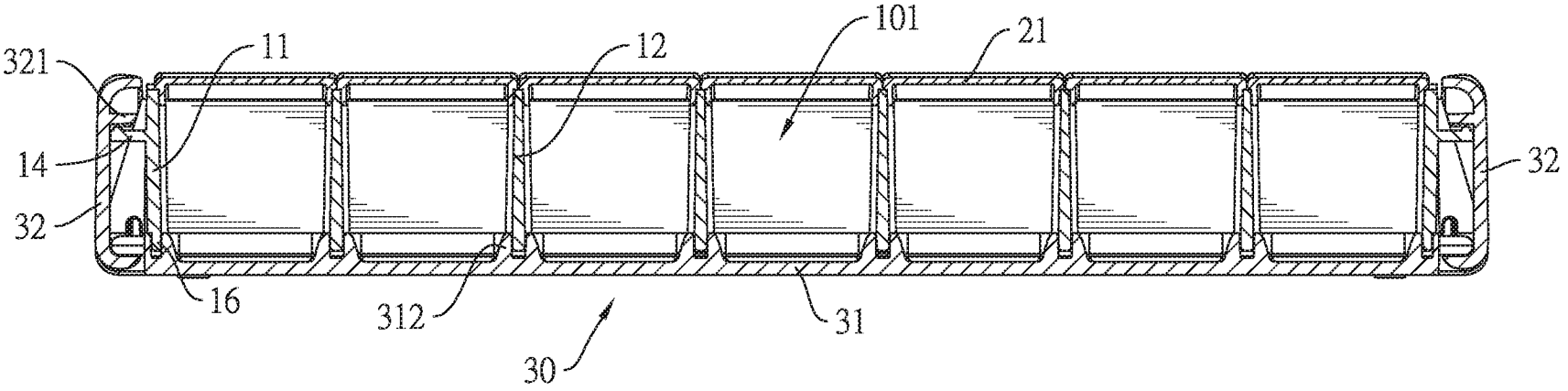
FIG. 5 is a cross-sectional front view of the pill box in FIG. 1.

With reference to FIGS. 1, 3, and 5, the front covers 21 are pivotally mounted to the container 10 and selectively cover the front side of the container 10 to seal the compartments 101 respectively. Each of the front covers 21 has an inner surface and a front annular frame 211. The inner surface of the front cover 21 faces toward the container 10. The front annular frame 211 is formed on the inner surface of the front cover 21 and corresponds in shape to a corresponding one of the compartments 101. When the front cover 21 covers the front side of the container 10, the front annular frame 21 protrudes in the corresponding one of the compartments 101.

Figure 6:
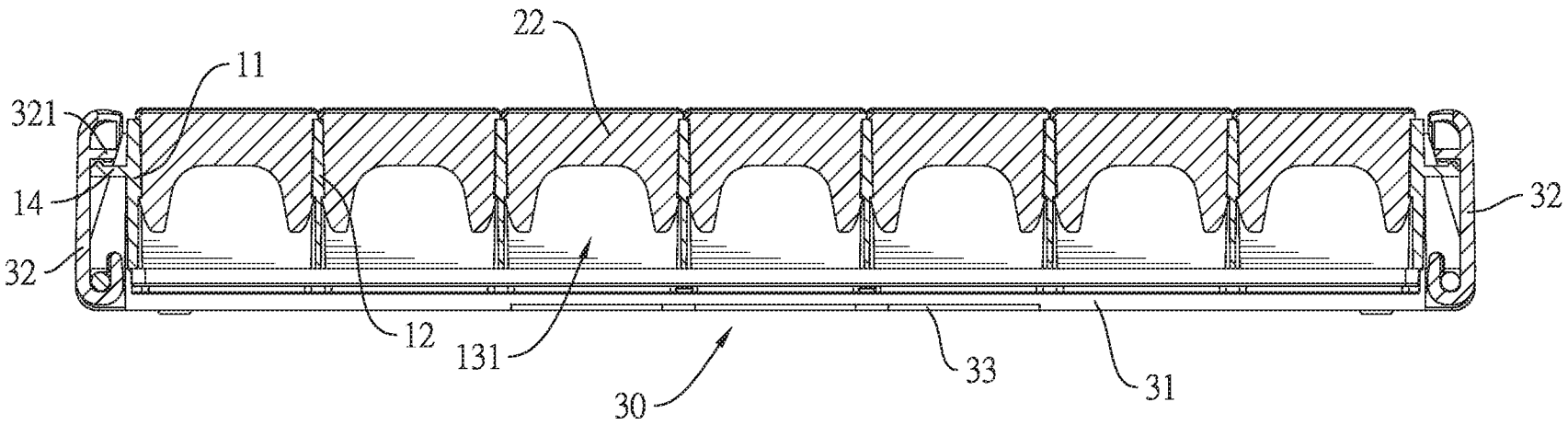
FIG. 6 is another cross-sectional front view of the pill box in FIG. 1.
Figure 7:
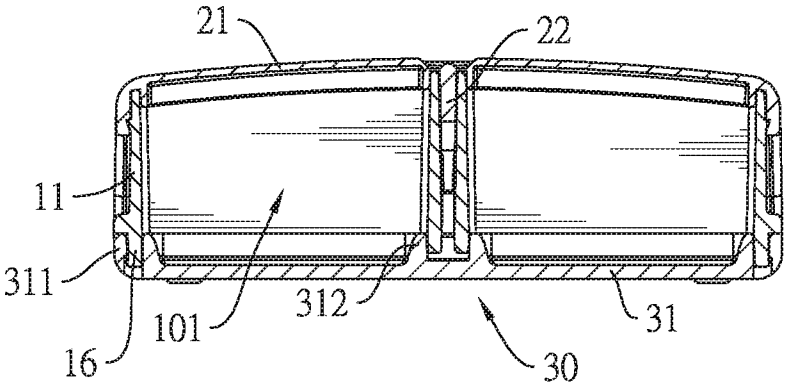
FIG. 7 is a cross-sectional side view of the pill box in FIG. 1.
Figure 8:
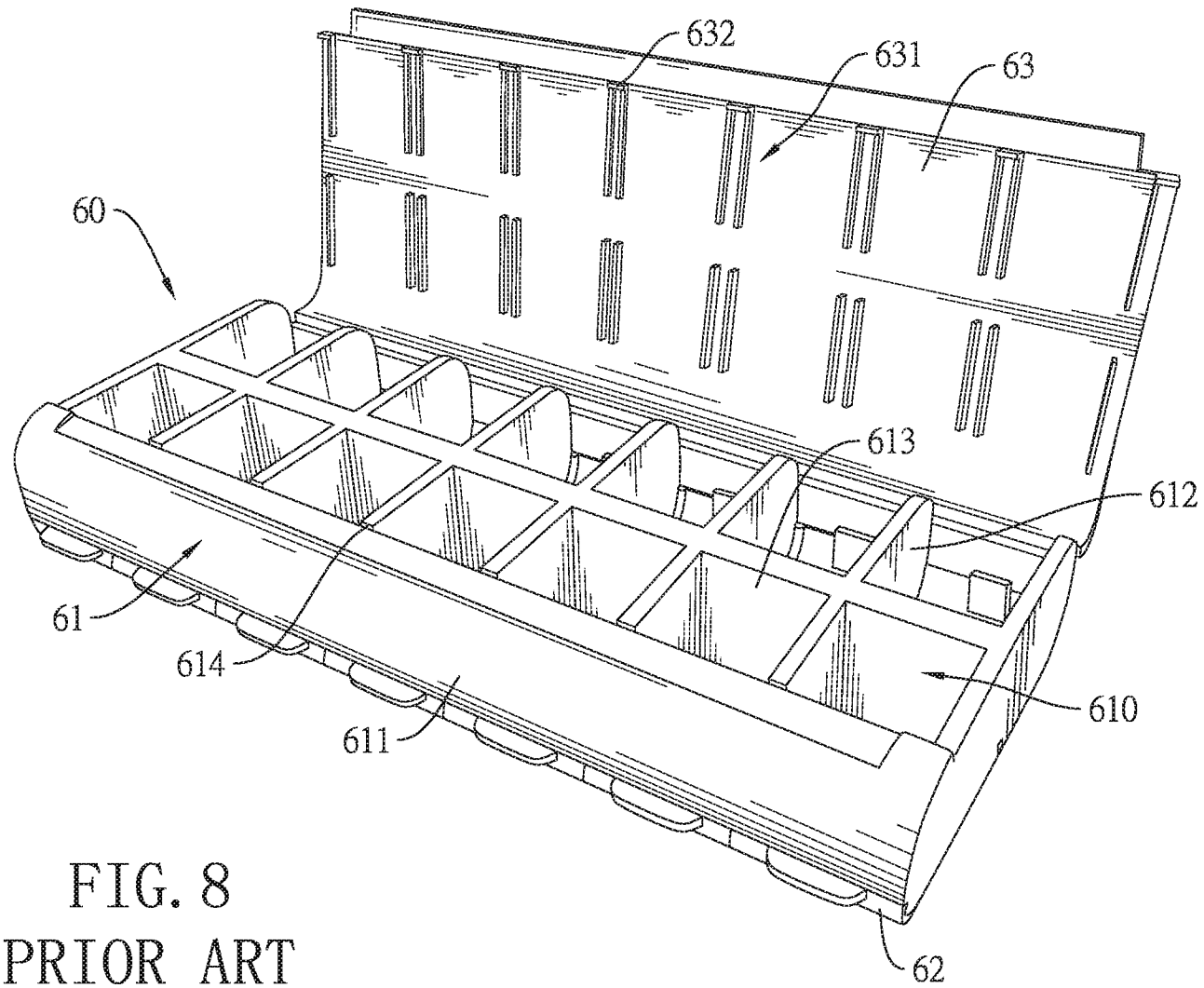
FIG. 8 PRIOR ART
FIG. 8 is a perspective view of a conventional pill box in accordance with the prior art, showing a rear lid cover being opened.
Figure 9:
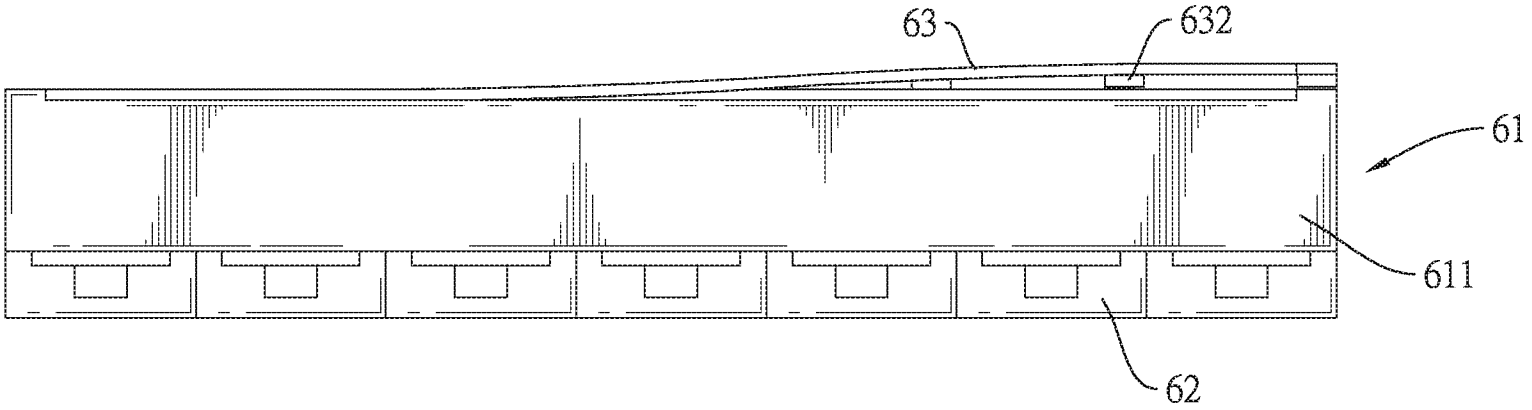
FIG. 9 PRIOR ART
FIG. 9 is a front view of the conventional pill box in FIG. 8, showing the rear cover improperly covering a container.

With further reference to FIGS. 6 and 7, in the preferred embodiment, each of the at least one lengthwise partition 13 has multiple insertion slots 131 formed through the lengthwise partition 13; and each of the front cover 21 has a proximal edge and a distal edge 212. The proximal edge of the front cover 21 is pivotally attached to an insertion panel 22 and the insertion panel 22 is securely inserted in a corresponding one of the insertion slots 131 of the lengthwise partition 13, such that the front cover 21 is pivotally mounted onto the container 10. The distal edge 212 of the front cover 21 is detachably connected with the peripheral sidewall 11 of the container 10 to selectively cover the front side of the container 10.

Furthermore, in the preferred embodiment, each two of the front covers 21 are attached to the same insertion panel 22. In other implementations, the front covers may be attached to different insertion panels respectively.

As shown in FIGS. 2 and 4, the rear lid 30 is detachably mounted on the rear side of the container 10 and has a main covering panel 31, two side locking panels 32, and a positioning plate 33.

The main covering panel 31 covers the rear side of the container 10 and has an inner surface, an outer surface, two opposite side edges, an outer peripheral frame 311, multiple inner annular frames 312, and at least one aligning holes 313. The inner surface of the rear lid 30 faces toward the container 10. The outer surface of the rear lid 30 is defined opposite to the inner surface of the rear lid 30.

The outer peripheral frame 311 is formed on the inner surface of the main covering panel 31. When the main covering panel 31 covers the rear side of the container 10, the outer peripheral frame 311 surrounds the compartment frame 16.

The inner annular frames 312 are formed on the inner surface of the main covering panel 31, are surrounded by the outer peripheral frame 311, and correspond in position to the compartments 101 of the container 10 respectively. Each of the inner annular frames 312 corresponds in shape to a corresponding one of the compartments 101. When the main covering panel 31 covers the rear side of the container 10, the inner annular frames 312 protrude in the corresponding compartments 101 respectively and the compartment frame 16 of the container 10 surrounds the inner annular frames 312.

The at least one aligning hole 313 is formed through the main covering panel 31. Each of the at least one aligning hole 313 corresponds in position to a corresponding one of the aligning protrusion 15 of the container 10. When the main covering panel 31 covers the rear side of the container 10, the at least one aligning protrusion 15 protrudes into the at least one aligning hole 313.

The two side locking panels 32 are pivotally connected to the two opposite side edges of the main covering panel 31. Each of the side locking panels 32 has a second locking portion 321. The second locking portion 321 detachably engages with the first locking portions 14 of the container 10 respectively. When the second locking portions 321 of the side locking panels 32 engages with the first locking portions 14 of the container 10, the rear lid 30 is securely held on the container 10.

In the preferred embodiment, the first locking portions 14 of the container 10 and the second locking portions 321 of the side locking panels 32 are an elongated protrusions. Thus, when the side locking panels 32 are pushed to pivot toward the peripheral sidewall 11 of the container 10, each of the second locking portions 321 and a corresponding one of the first locking portions 14 securely hook with each other.

The positioning plate 33 is ferromagnetic and is embedded in the outer surface of the main covering panel 31. Since the ferromagnetic positioning plate 33 can be attracted by magnetic elements, the pill box can be stably placed at a specific position in which a magnetic element is embedded.

The pill box as described has the following advantages. With the compartment frame 16 of the container 10 protruding in a groove formed between the outer peripheral frame 311 and the inner peripheral frames 312 of the main covering panel 31 of the rear lid 30 when the main covering panel 31 covers the rear side of the container 10 and by hooking the two side locking panels 32 to the peripheral sidewall 11 of the container 10, the rear side of the container 10 can be tightly sealed by the rear lid 30 easily. Dust and moisture does not enter the pill box through the rear side of the container 10 while the rear lid 30 covers the rear side of the container 10. Accordingly, the pills can be properly reserved in the pill box of the present application.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A pill box comprising:

a container having a peripheral sidewall; and multiple crosswise partitions surrounded by and connected to the peripheral sidewall and dividing an interior of the container into multiple compartments;

two first locking portions oppositely formed on an outer surface of the peripheral sidewall; and a compartment frame formed on a rear side of the container and disposed along the peripheral sidewall and the crosswise partition;

multiple front covers pivotally mounted to the container and selectively covering a front side of the container to seal the compartments respectively; and a rear lid detachably mounted on the rear side of the container and having a main covering panel covering the rear side of the container and having an outer peripheral frame formed on an inner surface of the main covering panel, wherein when the main covering panel covers the rear side of the container, the outer peripheral frame surrounds the compartment frame; and multiple inner annular frames formed on the inner surface of the main covering panel, surrounded by the outer peripheral frame and corresponding in position to the compartments of the container respectively, each of the inner annular frames corresponding in shape to a corresponding one of the compartments, wherein when the main covering panel covers the rear side of the container, the inner annular frames protrude in the corresponding compartments respectively and the compartment frame of the container surrounds the inner annular frames; and two side locking panels pivotally connected to two opposite side edges of the main covering panel, each of the side locking panels having a second locking portion, and the second locking portion detachably engaging with the first locking portions of the container respectively.

2. The pill box as claimed in claim 1, wherein each of the front covers has a front annular frame formed on an inner surface of the front cover and corresponding in shape to a corresponding one of the compartments, wherein when the front cover covers the front side of the container, the front annular frame protrudes in the corresponding one of the compartments.

3. The pill box as claimed in claim 2, wherein the container further has at least one lengthwise partition, and the at least one lengthwise partition along with the crosswise partitions are surrounded by and are connected to the peripheral sidewall of the container and divide the interior of the container into said multiple compartments; and the compartment frame of the container is disposed along the peripheral sidewall, the crosswise partition, and the at least one lengthwise partition.

4. The pill box as claimed in claim 3, wherein the container further has at least one aligning protrusion protruding from the rear side of the container the main covering panel of the rear lid further has at least one aligning holes formed through the main covering panel, and each of the at least one aligning hole corresponds in position to a corresponding one of the aligning protrusion of the container, wherein when the main covering panel covers the rear side of the container, the at least one aligning protrusion protrudes into the at least one aligning hole.

5. The pill box as claimed in claim 3, wherein the rear lid further has a positioning plate being ferromagnetic and embedded in the outer surface of the main covering panel.

6. The pill box as claimed in claim 2, wherein the container further has at least one aligning protrusion protruding from the rear side of the container the main covering panel of the rear lid further has at least one aligning holes formed through the main covering panel, and each of the at least one aligning hole corresponds in position to a corresponding one of the aligning protrusion of the container, wherein when the main covering panel covers the rear side of the container, the at least one aligning protrusion protrudes into the at least one aligning hole.

7. The pill box as claimed in claim 2, wherein the rear lid further has a positioning plate being ferromagnetic and embedded in the outer surface of the main covering panel.

8. The pill box as claimed in claim 1, wherein the container further has at least one lengthwise partition, and the at least one lengthwise partition along with the crosswise partitions are surrounded by and are connected to the peripheral sidewall of the container and divide the interior of the container into said multiple compartments; and the compartment frame of the container is disposed along the peripheral sidewall, the crosswise partition, and the at least one lengthwise partition.

9. The pill box as claimed in claim 8, wherein the container further has at least one aligning protrusion protruding from the rear side of the container the main covering panel of the rear lid further has at least one aligning holes formed through the main covering panel, and each of the at least one aligning hole corresponds in position to a corresponding one of the aligning protrusion of the container, wherein when the main covering panel covers the rear side of the container, the at least one aligning protrusion protrudes into the at least one aligning hole.

10. The pill box as claimed in claim 9, wherein each of the at least one lengthwise partition has multiple insertion slots formed through the lengthwise partition; and each of the front cover has a proximal edge pivotally attached to an insertion panel, and the insertion panel securely inserted in a corresponding one of the insertion slots of the lengthwise partition; and a distal edge detachably connected with the peripheral sidewall of the container to selectively cover the front side of the container.

11. The pill box as claimed in claim 10, wherein each two of the front covers are attached to the same insertion panel.

12. The pill box as claimed in claim 8, wherein the rear lid further has a positioning plate being ferromagnetic and embedded in the outer surface of the main covering panel.

13. The pill box as claimed in claim 8, wherein each of the at least one lengthwise partition has multiple insertion slots formed through the lengthwise partition; and each of the front cover has a proximal edge pivotally attached to an insertion panel, and the insertion panel securely inserted in a corresponding one of the insertion slots of the lengthwise partition; and a distal edge detachably connected with the peripheral sidewall of the container to selectively cover the front side of the container.

14. The pill box as claimed in claim 13, wherein each two of the front covers are attached to the same insertion panel.

15. The pill box as claimed in claim 1, wherein the container further has at least one aligning protrusion protruding from the rear side of the container the main covering panel of the rear lid further has at least one aligning holes formed through the main covering panel, and each of the at least one aligning hole corresponds in position to a corresponding one of the aligning protrusion of the container, wherein when the main covering panel covers the rear side of the container, the at least one aligning protrusion protrudes into the at least one aligning hole.

16. The pill box as claimed in claim 1, wherein the rear lid further has a positioning plate being ferromagnetic and embedded in the outer surface of the main covering panel.

* * * * *